United States Patent [19]

Kaufman

[11] Patent Number: 4,586,486

[45] Date of Patent: May 6, 1986

[54] MULTILEVEL AIR DISTRIBUTION PANEL FOR AIR VENTILATION HOOD

[75] Inventor: Arnold S. Kaufman, Studio City, Calif.

[73] Assignee: National Air Systems, Inc., Glendale, Calif.

[21] Appl. No.: 628,290

[22] Filed: Jul. 6, 1984

[51] Int. Cl.[4] ..... F21C 15/08; F23J 11/00

[52] U.S. Cl. ..... 126/299 D; 98/36

[58] Field of Search ..... 98/36, 115 R, 115 LH; 126/299 R, 299 D

[56] References Cited

U.S. PATENT DOCUMENTS

| | | | |
|---|---|---|---|
| 3,517,526 | 6/1970 | MacMaster et al. | 98/36 X |
| 3,812,684 | 5/1974 | Brown | 98/36 X |
| 4,134,394 | 1/1979 | Otenbaker | 126/299 D |
| 4,186,727 | 2/1980 | Kaufman et al. | 126/299 D |
| 4,346,692 | 8/1982 | McCauley | 126/299 D |
| 4,475,534 | 10/1984 | Moriarty | 126/299 D |
| 4,484,563 | 11/1984 | Fritz et al. | 126/299 D |

FOREIGN PATENT DOCUMENTS

| | | | |
|---|---|---|---|
| 58-127033 | 7/1983 | Japan | 98/36 |

*Primary Examiner*—Harold Joyce

*Attorney, Agent, or Firm*—Beehler, Pavitt, Siegemund, Jagger & Martella

[57] ABSTRACT

Improved air flow characteristics are obtained in a ventilating hood of the make-up type used over cooking surfaces by providing an air distribution panel comprising a panel frame to which is mounted a duct which serves to partition air flow between a first path exterior to the duct and a second path through said duct. A first air flow restricting screen is mounted to the panel frame externally of said duct for restricting air flow through the first flow path, and a second air flow restricting screen is mounted within said duct for restricting the air flow therethrough. The duct includes an internal wall surface which is angled towards the first flow path so as to direct air flow through the duct into merger with air flowing through the first flow path.

28 Claims, 6 Drawing Figures

MULTILEVEL AIR DISTRIBUTION PANEL FOR AIR VENTILATION HOOD

BACKGROUND OF THE INVENTION

1. Field of the Invention

The present invention relates to air ventilation systems and, more particularly, is directed to an improved air distribution panel for air ventilation hoods of the type used over open cooking surfaces or grills for removing heated, grease laden or otherwise contaminated air from within the kitchen area.

2. State of the Prior Art

The present invention relates to a particular type of ventilating hood known in the industry as a "make-up air" hood and exemplified by this applicant's disclosure in U.S. Pat. No. 4,186,727. This type of ventilating hood is characterized by a horizontally extended make-up air hood, a horizontally extended exhaust hood, and a longitudinally extended divider wall between the two hoods. The make-up hood is provided with an inlet connected by suitable ducting to the exterior of the building for admitting make-up air into the make-up hood. The exhaust hood is also connected to an outlet for exhausting contaminated air to the exterior atmosphere. The make-up hood includes walls which, together with the divider wall and the air diffuser, define a make-up plenum. Air is forced into the make-up air plenum and drawn from the exhaust air plenum by means of suitable fans to create a pressure differential across the bottom of the dividing wall such that make-up air flows downwardly through the make-up plenum, discharging downwardly along the divider wall to a region below the lower end of the divider wall, turns horizontally toward the exhaust hood and then flows upwardly thereinto. Vortex baffles are typically provided in the exhaust plenum to bring about efficient mixing of make-up air with contaminated air rising from the underlying cooking surface, which mixed air then passes through grease filters and is exhausted to the outside. The make-up plenum is further provided with air distribution panels extending longitudinally within the make-up hood and disposed above the bottom of the divider wall. Downward flow of air from the make-up plenum is restricted by the air distribution panels in order to maintain a positive pressure in the make-up plenum and thereby evenly distribute the flow of make-up air along the length of the make-up hood.

The ventilating hood is normally dimensioned such that the exhaust hood extends substantially over the entire cooking surface while the make-up portion of the hood overlies an area in front of the stove or grill where cooks and other kitchen personnel normally stand while working. It was found in practice that only a portion of the downwardly discharging make-up air returns towards the exhaust side of the hood as intended. A substantial portion of the make-up air stream would instead discharge downwardly onto the heads of personnel standing in front of the cooking surface. Such downward flow of outside air could be substantially colder or warmer than air in the kitchen and is therefore not only uncomfortable to personnel working underneath the hood, but also interferes with the efficient heating or air-conditioning of the kitchen. Further still, such divided flow of make-up air reduces the efficiency of the ventilating hood in extracting contaminated air.

To avoid this problem, it was found necessary to partially close off the air distribution panels such that make-up air was discharged downwardly only in close proximity to the dividing wall where the make-up air would be effectively captured by the negative pressure in the exhaust hood and would therefore flow under the lower edge of the dividing wall as intended. The prior art air distribution panels thus consist of a rectangular frame in which is disposed a solid panel extending the full length, but only approximately half the width of the frame. Air flow through the remaining opening in the frame is restricted by means such as a perforated plate and one or more layers of screen fabric having a mesh smaller than the openings in the plate. To maintain a positive air pressure in the make-up plenum. The distribution panels are mounted within the make-up hood with the open side of the panel (i.e., the portion of the panel which includes the perforated plate and the mesh) adjacent to the dividing wall of the hood, while the closed side of the distribution panel is adjacent a wall of the make-up hood opposite the dividing wall. Downward flow of make-up air is thus limited to a region near the dividing wall and extending the full length of said dividing wall.

While this approach solved the problem of discharge of make-up air into the kitchen area and onto kitchen personnel, it also significantly reduced the volume of make-up air flowing into the exhaust hood, thus reducing the efficiency of the ventilating system.

SUMMARY OF THE INVENTION

The present invention overcomes these and other shortcomings of the prior art by providing the ventilating hood with multilevel air distribution panels which do not have portions closed off to air flow, thus allowing passage of a greater volume of make-up air.

The air distribution panels improved according to the present invention differ from the above-described prior art air distribution panels in that the solid panel closing off the portion of the panel spaced from the dividing wall is replaced by a second air-flow restricting element disposed upstream of a first air-flow restricting element which is adjacent to the dividing wall. The first and second air flow restricting elements maintain positive air pressure in the make-up plenum to ensure even air flow throughout the length of the air distribution panels and may each take the form of a perforated plate backed by a screen mesh fabric. A partition extends vertically between the first and second air-flow restricting elements such that air flowing downwardly in the make-up plenum is divided into a first air stream flowing through the lower or first flow restricting element and a second air stream flowing through the second restricting element. The partition may take the form of a duct extending vertically from the upper air-flow restricting element and having an outlet opening at substantially the same level as the lower air flow restricting element. The first airstream flowing through the first restricting element is discharged near the bottom of the dividing wall and turns under the lower end of the dividing wall towards the exhaust hood as in the prior art distribution panel. A lower portion of the partition extending between the first and second air-restricting elements is angled towards the dividing wall so as to encourage the turning of the second air stream in that direction such that it joins the first air stream in that direction, and also flows under the lower edge of the dividing wall towards the exhaust hood.

Previously installed ventilating hoods can be easily upgraded by exchanging the existing prior art distribution panels for new air distribution panels constructed according to the present disclosure.

DETAILED DESCRIPTION OF THE PREFERRED EMBODIMENT

Figure 1:
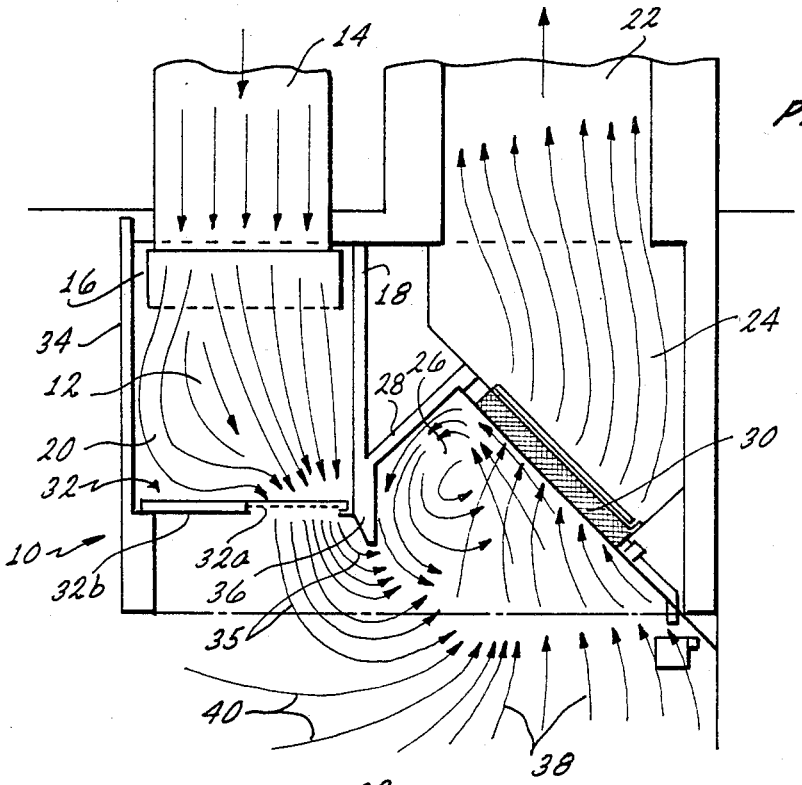
FIG. 1 PRIOR ART
FIG. 1 is a cross-section taken in elevation of a ventilating hood using prior art air-distribution panels.

FIG. 1 shows a make-up type ventilating hood 10 which includes a make-up air plenum 12, a make-up air inlet duct 14 and a make-up air diffuser 16 mounted to the duct 14 at the inlet to the make-up air plenum. The make-up air plenum 12 is defined between a longitudinally extending dividing wall 18 and an opposing wall 34. The ventilating hood 10 further includes an exhaust or grease duct 22 for drawing air from an exhaust air plenum 24. A vortex chamber 26 is defined between a vortex baffle 28, the dividing wall 18, and a grease filter 30 separating the vortex chamber from the exhaust air plenum 24.

Air is forced through the inlet duct 14 and the air diffuser 16 into the make-up air plenum 12 by means of a first fan or blower (not shown). One or more air distribution panels 32 are supported between the dividing wall 18 and an opposing wall 34 of the make-up air hood and above the lower end 36 of the dividing wall 18. The prior art air-distribution panel shown in FIGS. 1 and 1*a* includes an air-flow restricting element 32*a* typically comprised of a perforated sheet 33*a* backed by at least one layer of a mesh fabric 33*b*, which pressurizes the make-up air plenum 12 by partially restricting flow of air through the panel 32. Air discharged through the distribution panel 32 flows downwardly and then turns horizontally under the lower end 36 of the dividing wall 18 towards the low-pressure zone in the vortex chamber 26 of the exhaust hood as suggested by arrows 35. The make-up air flow mixes there with contaminated air rising from the cooking surface as suggested by arrows 38, and also mixes with some air drawn from the room as suggested by arrows 40. The mixed air then flows through the grease filter 30 and rises through the exhaust plenum 24 into the exhaust duct 22 from where the heated, grease-laden air is drawn by a second fan or blower (not shown) and discharged to the exterior atmosphere. While the above description of the general structure and operation of the hood 10 will suffice for an understanding of the improvement disclosed herein, a more detailed description of the ventilating hood and its manner of operation will be found in U.S. Pat. No. 4,186,727 issued to this applicant.

Figure 1A:
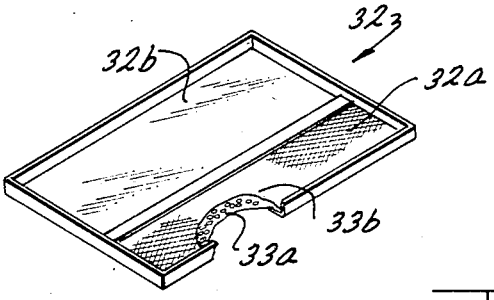
FIG. 1a PRIOR ART
FIG. 1*a* is a perspective view partly broken away of a prior art air distribution panel.

Referring to FIG. 1, the air-distribution panel 32 of the prior art is seen to be supported between supporting flanges provided on the dividing wall 18 and an opposing wall 34 of the make-up air hood. The panel 32 is generally planar and rectangular in configuration as best seen in FIG. 1*a*. The panel 32 is divided into two longitudinally extending portions, a closed portion 32*b* which lies adjacent the front wall 34 of the hood, and a portion 32*a* which is open to air flow, but is provided with air-flow restricting means such as a perforated sheet backed with a mesh fabric laid one over the other. The air-flow restricting element serves to build up positive air pressure in the make-up plenum 12 as has been explained.

It was found that if the air restricting element 32*a* extended the full width of the prior art panel 32, air flowing through the panel in the vicinity of the front wall 34 was too far removed from the low pressure area in the vortex chamber 26 and therefore failed to turn under the lower end 36 of the dividing wall 18 towards the exhaust hood. Instead, air flowing downwardly near the front wall 34 continued in a downward direction and discharged onto personnel standing in front of the cooking surface underneath the grill, as well as onto the cooking surface itself. As a result it was found necessary to install a closed panel element 32*b* to thereby close air flow in the region adjacent to the front wall 34 and restrict air flow through the air distribution panel to a region more closely adjacent to the dividing wall 18. This approach did prevent undesirable discharge of make-up air, but at the expense of overall efficiency of the ventilating hood.

Figure 2:
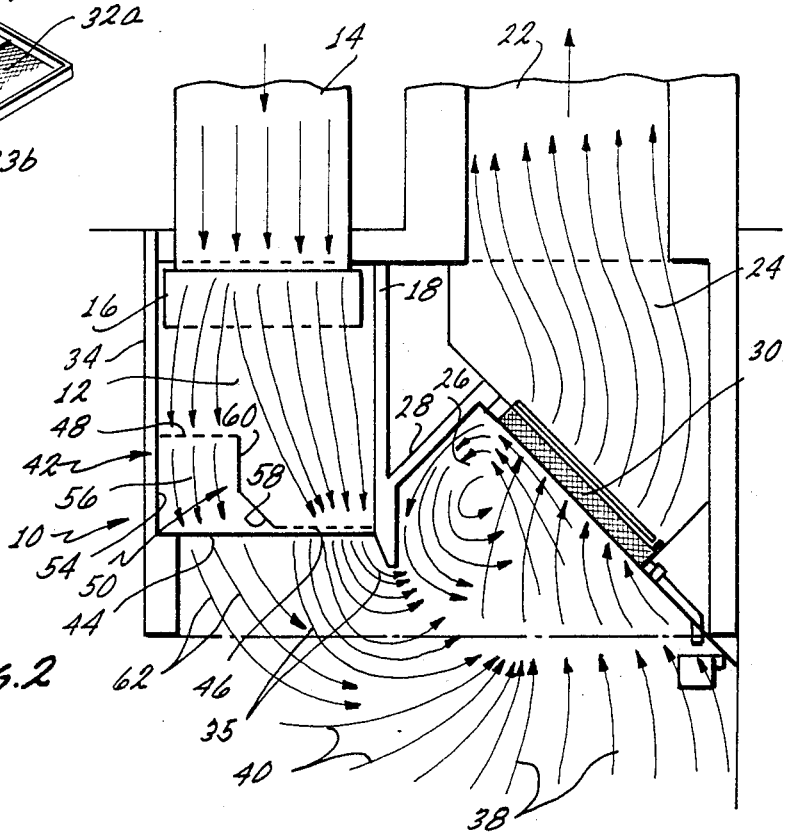
FIG. 2 shows the ventilating hood of FIG. 1 in which the prior art air-distribution panels have been replaced by the improved air-distribution panels of this invention.
Figure 4:
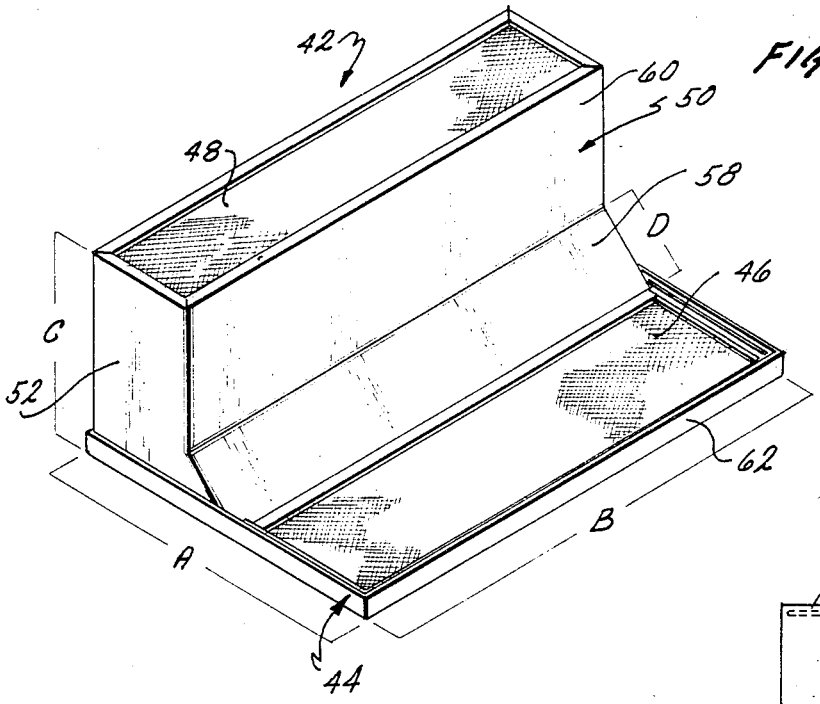
FIG. 4 is a top perspective view of an improved air-distribution panel.
Figure 3:
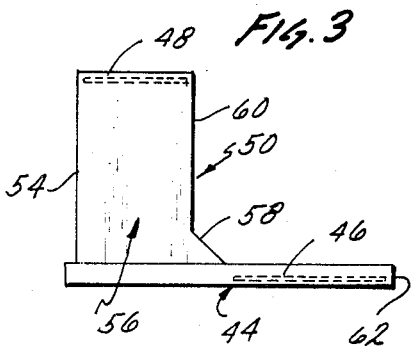
FIG. 3 is a side elevational view of an improved air distribution panel.
Figure 5:
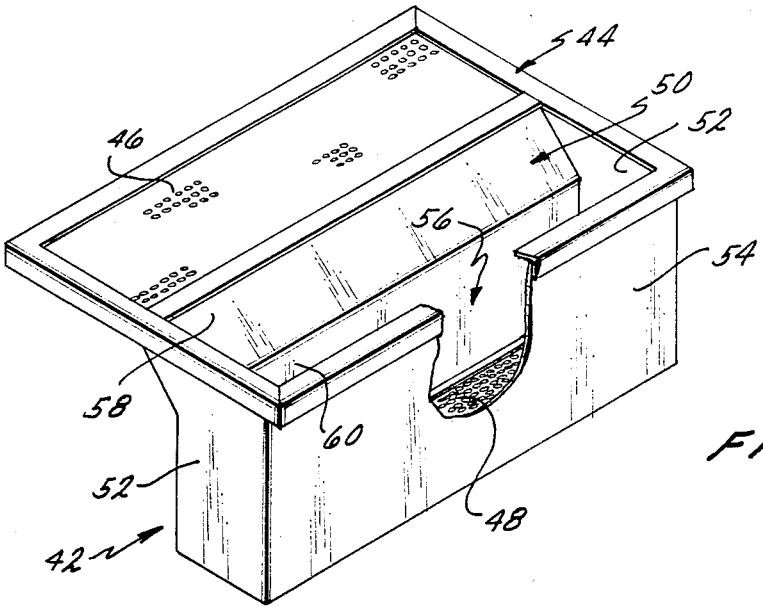
FIG. 5 is a bottom perspective view of the improved air-distribution panel.

A more effective solution to the problem is provided by an air-distribution panel 42 improved according to this invention, shown in FIG. 2 installed in a ventilation hood 10 which is otherwise similar to that of FIG. 1. As best seen in FIGS. 3, 4 and 5, the improved panel has a rectangular frame 44 having a width A dimensioned so as to bridge the distance between the dividing wall 18 and the front wall 34 of the make-up hood in a manner analogous to that of the prior art distribution panel 32 in FIG. 1. The novel panel 42 further comprises a first or lower longitudinally extending air flow restricting element 46 supported within the rectangular frame 44, and a second or upper longitudinally extending air flow restricting element 48 disposed above and spaced vertically from the first air flow restricting element 46. Both flow restricting elements are preferably made of a perforated plate, and a single layer of woven mesh fabric having a finer mesh than the perforations in the plate laid against the upstream side of the perforated plate and secured thereagainst as by clamping along the edges.

A partition wall 50 extends vertically between the upper and lower air flow restricting elements and together with end walls 52 and a back wall 54 defines a duct 56 which has an inlet restricted by upper flow restricting element 48 and is open at its lower end at the level of the lower flow restrictor 46. The partition 50 has a lower portion 58 bent at a 45 degree angle relative to the upper portion 60 in a direction away from the back wall 54 and towards the lower flow restricting element 46. This bent portion 58 of the partition 50 imparts an interior flare to the outlet of duct 56 in the direction of the dividing wall 18 of the ventilating hood when the panel 42 is installed in the make-up air hood 10. The panel 42 is installed such that the back wall 54 is adjacent to the front wall 34 of the ventilating hood 10, while the edge 62 of the panel frame 44 is supported along the dividing wall 18 as seen in FIG. 2.

The distribution of air flow between the first and second flow restricting elements 46, 48, respectively, is determined among other factors by the relative surface area of these two elements. Thus, a greater volume of air may be directed towards the region adjacent to the dividing wall 18 by decreasing the width of lower flow-restrictor 42 while proportionately increasing the width of upper flow-restrictor 46. The distribution of air flow may also be adjusted by increasing or decreasing the apertures of the perforated panel and/or the mesh fabric of each of the flow-restrictor elements. If the apertures in one flow-restrictor element are increased relative to the apertures in the other, the air flow through that one flow restrictor will increase in relation to the other flow restrictor.

The dimensions of the improved air-flow divider panel are not critical and may be adjusted to suit the requirements of particular installations. By way of example only and with reference to FIG. 4, the lower air-restriction element 46 may be nine inches in width along dimension A, while the upper flow restricting element 48 may be six inches wide along the same dimension. The height of the upper portion 60 of the partition 50 along dimension C may be approximately 10 inches and the angled lower portion 58 may be approximately two to three inches in height along dimension D such that the vertical spacing of upper flow restrictor 48 above the lower flow restrictor 46 is approximately 12 inches. These dimensions have been found suitable for air distribution panels to be installed in a hood which has a make-up plenum between two and three feet in height. The length B of the panel may be any length suitable to the dimensions of the particular hood in which the panel is to be installed. Typically, several air distribution panels 42 are installed end-to-end to span the full length of the make-up plenum. The angled lower portion 58 of the partition 50 is preferably angled at 45 degrees to the upper portion 60 of the partition, and thus at 45 degrees to the direction of air flow through the upper portion of duct 56 of the distribution panel. This angle, however, may lie within a range of e.g. 30 to 60 degrees.

The effectiveness of the improved distribution panel is believed due to a combination of the vertical spacing between the two flow restrictors 46, 48 and the angling of the lower portion 58 of the partition 50 towards the dividing wall 18 which induces the second airstream 62 flowing downwardly through the duct 56 to turn horizontally towards the exhaust hood and join the first airstream 35 flowing through the lower flow restrictor 46 in the same direction.

While a particular embodiment of the invention has been shown and illustrated for purposes of clarity, many changes, substitutions and alterations may be made by those skilled in the art without departing from the spirit and scope of the invention which is defined by the following claims:

I claim:

1. In a ventilating hood structure for use above a cooking area:

a horizontally extending make-up hood;

a horizontally extended exhaust hood;

make-up and exhaust hoods, said make-up hood having walls including an opposing wall defining a makeup plenum with said divider wall;

means forming an inlet for conducting make-up air into said make-up hood;

means forming an outlet for exhausting air from said exhaust hood;

air distribution means extending longitudinally within said make-up hood and being disposed above the bottom of said divider wall such that air flowing through said air distribution means is discharged downwardly along said divider wall to a region below its lower end and then turns toward said exhaust hood;

said air distribution means including partition means in said make-up hood for dividing air flow through said distribution means into a first airstream adjacent to said dividing wall and a second airstream spaced from said dividing wall, first air flow restricting means disposed above the lower edge of said dividing wall for restricting flow of said first airstream, and second flow restricing means disposed upstream of said first flow restricting means for restricting flow of said second airstream, said partition means including a lower portion angled towards said divider wall for directing said second airstream towards said exhaust hood and into merger with said first airstream.

2. The ventilating hood structure of claim 1 wherein said lower portion of said partition is bent at an angle of between 30 and 60 degrees to the upper portion of the partition.

3. The ventilating hood structure of claim 1 wherein said first and second air flow restricting means each include perforated plate means.

4. The ventilating hood structure of claim 4 wherein said first and second air flow restricting means each further includes a screen fabric.

5. The ventilating hood structure of claim 1 wherein said first and second air flow restricting means each includes a perforated plate and a screen fabric disposed one above the other.

6. The ventilating hood structure of claim 1 wherein said air distribution means comprises one or more panels removably supported between said divider wall and said opposing wall, each said panel including a panel frame, said partition means forming part of a duct extending upwardly from each said panel frame, said first flow restricting means being mounted to said frame exteriorly to said duct, said second flow restricting means being disposed in said duct and spaced upwardly of said first flow restricting means.

7. The ventilating hood structure of claim 6 wherein said flow restricting means include perforated plate means.

8. The ventilating hood structure of claim 7 wherein said flow restricting means further include a screen fabric.

9. The ventilating hood structure of claim 6 wherein each of said flow restricting means comprises a perforated plate and a screen fabric.

10. The ventilating hood structure of claim 9 wherein said screen fabric is upstream of said perforated plate.

11. The ventilating hood structure of claim 10 further comprising means clamping said perforated plates and said screen fabric together.

12. The ventilating hood structure of claim 6 wherein said air distribution panel frame is rectangular and said duct is of rectangular cross-section.

13. The ventilating hood structure of claim 12 wherein said duct cross-section extends substantially across the full length of said rectangular panel frame, but less than the full width of said rectangular panel frame.

14. The ventilating hood structure of claim 12 wherein said second flow restricting means is supported at the upper end of said duct.

15. The ventilating hood structure of claim 12 wherein said first and second flow restricting means are planar and mutually parallel.

16. The ventilating hood structure of claim 13 wherein said frame has four sides lying in a common plane, said duct having four side walls extending between an upper end and a lower end, said lower end being attached to said frame such that one or more of said side walls define a first flowpath through said frame exterior to said duct and a second flowpath through said frame within said duct.

17. The ventilating hood structure of claim 16 wherein panel supporting flanges are provided on said divider wall and said opposing wall, the width of said rectangular frame being such as to bridge said supporting flanges.

18. For use with a make-up air ventilating hood of the type having a make-up plenum defined between a divider wall and an opposing hood wall, an exhaust plenum, means for supplying make-up air to said make-up plenum, and means for exhausting air from said exhaust plenum such that make-up air flows from said make-up plenum under the lower edge of said divider wall and is drawn into said exhaust plenum, an air distribution panel comprising:

a planar frame for mounting in said make-up plenum between said divider wall and said opposing hood wall, said frame having an upstream side and a downstream side, duct means attached to said frame on said upstream side so as to define a first make-up air flow path through said duct means and said frame and a second make-up air flow path through said frame external to said duct means, first air flow restricting means mounted to said frame adjacent to said dividing wall for restricting air flow through said first flow path, and second flow restricting means mounted to said duct means upstream of said first flow restricting means and adjacent said to opposing wall for restricting flow through said second flow path, said duct means including a lower wall portion flaring towards said first flow restricting means for directing air flowing through said second flow path into merger with air flowing through said first flow path and towards said exhaust plenum.

19. The panel of claim 18 wherein said flaring lower wall portion of said duct means is bent at an angle of between 30 and 60 degrees to the upper portion of the duct means.

20. The panel of claim 18 wherein said first and second air flow restricting means each include perforated plate means.

21. The panel of claim 20 wherein said first and second air flow restricting means each further includes a screen fabric.

22. The panel of claim 18 wherein said first and second air flow restricting means each includes a perforated plate and a screen fabric disposed one above the other.

23. The panel of claim 22 wherein said screen fabric is upstream of said perforated plate.

24. The panel of claim 22 further comprising means clamping said perforated plates and said screen fabric together.

25. The panel of claim 18 wherein said frame is rectangular and said duct is of rectangular cross-section and perpendicular to said frame, the duct cross-section extending substantially across the full length of said rectangular frame, but less than the full width of said rectangular frame.

26. The panel of claim 25 wherein said second flow restricting means is supported at the upper end of said duct.

27. The panel of claim 25 wherein said first and second flow restricting means are planar and mutually parallel.

28. The panel of claim 18 wherein said frame is rectangular and said duct defines a first flow path through said frame exterior to said duct and a second flow path through both said frame and said duct said first flow restricting means being disposed in said first flow path and said second flow restricting element being disposed within said duct.

* * * * *